US005084374A

United States Patent [19]

Waki et al.

[11] Patent Number: 5,084,374

[45] Date of Patent: Jan. 28, 1992

[54] SILVER HALIDE COLOR PHOTOGRAPHIC MATERIAL IMPROVED IN COLOR REPRODUCTION AND GRADATION REPRODUCTION

[75] Inventors: Kokichi Waki; Masahiro Asami, both of Minami-ashigara, Japan

[73] Assignee: Fuji Photo Film Co., Ltd., Kanagawa, Japan

[21] Appl. No.: 598,938

[22] Filed: Oct. 17, 1990

[30] Foreign Application Priority Data

Oct. 25, 1989 [JP] Japan ..... 1-278015

[51] Int. Cl.[5] ..... G03C 1/46

[52] U.S. Cl. ..... 430/504; 430/506; 430/571; 430/567; 430/583

[58] Field of Search ..... 430/504, 506, 571, 583, 430/567

[56] References Cited

U.S. PATENT DOCUMENTS 4,830,956 5/1989 Waki ..... 430/558

4,839,270 6/1989 Kojima et al. ..... 430/583

*Primary Examiner*—Charles L. Bowers, Jr.

*Assistant Examiner*—Janet C. Baxter

*Attorney, Agent, or Firm*—Burns, Doane, Swecker & Mathis

[57] ABSTRACT

There is disclosed a silver halide color photographic material having (A) a red-sensitive, (B) a green-sensitive, and (C) a blue sensitive silver halide emulsion layers, wherein the silver halide emulsion of each layer is a high-silver-chloride emulsion, and the silver halide emulsions of the red-sensitive and blue-sensitive layers is spectrally sensitized in the blue light region within a range satisfying specific relationships. Further two or more silver halide emulsions are mixed so that the gammas of the (A) red-sensitive and the (B) green-sensitive layers in the photosensitive region of the blue-sensitive layer may be in a limited range. The disclosure as described provides a silver halide color photographic material which can form a color image giving a stereoscopic feeling that can reproduce bright primary colors less in turbidity over the range from the low-density part to the high-density part, and which can produce fully the high-density region of primary colors with subtle shades.

10 Claims, 1 Drawing Sheet

SILVER HALIDE COLOR PHOTOGRAPHIC MATERIAL IMPROVED IN COLOR REPRODUCTION AND GRADATION REPRODUCTION

FIELD OF THE INVENTION

The present invention relates to silver halide color photographic materials, and more particularly to a silver halide color photographic material excellent in detail reproduction of a color image, low in color contamination, and excellent in color reproduction.

BACKGROUND OF THE INVENTION

In recent years there has been strong demand that the development processing step of silver halide color photographic materials is to be made rapid, and technical developments for making development processing short have been made one after another and introduced into the market. Specifically, there are, for example, improvements of the formulation of development, improvements of facilities, typically including mini-labs, and improvements of photographic materials.

As improvement in photographic materials, silver halide grains containing silver chloride, which allow a high rate of development, are now being increasingly used. In particular, by using photographic materials containing silver chlorobromide grains whose silver chloride content is 95% or over, the development processing step is made rapid.

In the case of color print materials wherein a silver halide having a silver chloride content of 95 mol % or over is used, since the inherent sensitivity is very low, color images less in color turbidity can be advantageously obtained, and when the color print material is combined with a dye-forming coupler whose subsidiary absorption is little in the blue region, such as a pyrazoloazole coupler, a brighter color image can be obtained.

On the other hand, the color image with subtle shades becomes flat, and disadvantageously it does not have deepness. When a photographic object having colors is shaded, as one looks at the area near the shaded part, it changes from the region where colors can be recognized as colored gradually to a region where colors are recognized as black. When this is reproduced in the above color print material, the image will be such that, near the shaded part, the region is saturated in terms of color, but the region does not change to black (there is an extinction of color gradation). This phenomenon becomes more severe when a print is made from a color negative, wherein the interlayer effect is emphasized.

JP-A ("JP-A" means unexamined published Japanese patent application) Nos. 91657/1986 and 68754/1989 disclose that one emulsion layer is spectrally sensitized to have sensitivity in two spectral regions, such that emulsion layer may have sensitivity lower than the main emulsion layer. For example, a spectral sensitizer for red sensitivity and a spectral sensitizer for green sensitivity are added to a red-sensitive emulsion layer so that the green sensitivity of the red-sensitive emulsion layer is made lower than the green sensitivity of the green-sensitive emulsion layer. JP-A No. 68754/1984 describes that preferably the sensitivity difference is 0.5 to 2.0 log E. However, color reproduction and detail reproduction are not made adequate by these prior techniques only, and in particular when a silver chlorobromide emulsion high in silver bromide content is used or gradation is made soft, it becomes impossible to attain a good effect.

SUMMARY OF THE INVENTION

The object of the present invention is to provide a silver halide color photographic material that has the advantage of silver halide grains having a silver chloride content of 95 mol % or over, and, with bright color reproduction quality retained, it can faithfully reproduce the details of a color image having shades; in other words, it gives a good detail reproduction.

Other and further objects, features, and advantages of the invention will be appear more fully form the following description taken in connection with the accompanying drawing.

DETAILED DESCRIPTION OF THE INVENTION

Figure 1:
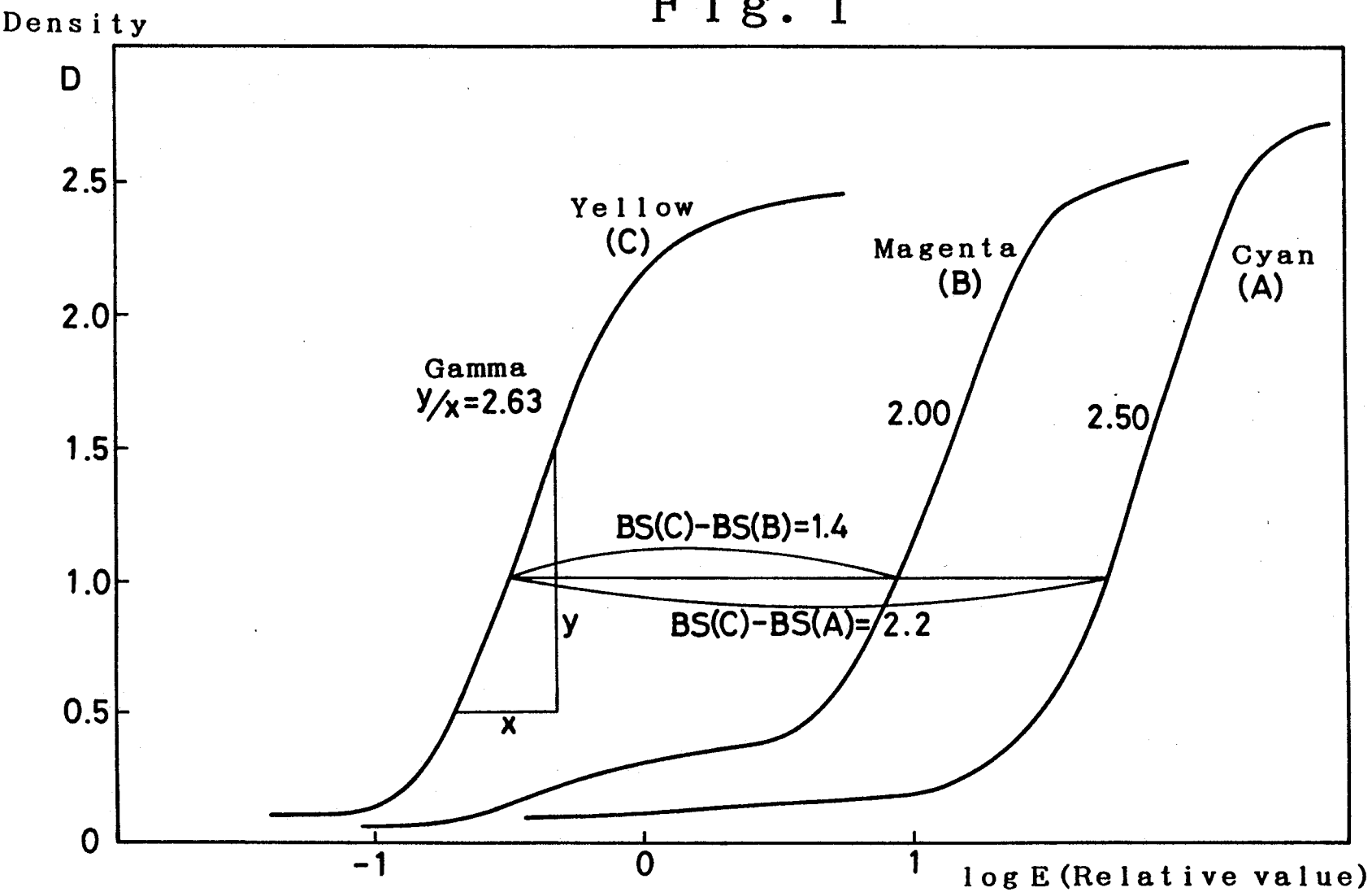
FIG. 1 shows sensitometry curves of the respective layers of Sample (117) of Example 1 exposed to light for the blue light region, wherein the vertical axis represents the optical density (D) and the horizontal axis represents the exposure amount (log E).

The above object of the present invention has been achieved by providing a silver halide color photographic material having a red-sensitive silver halide emulsion layer (A), a green-sensitive silver halide emulsion layer (B), and a blue-sensitive silver halide emulsion layer (C), characterized in that silver halide emulsions contained in the layers (A), (B), and (C) are silver chlorobromide emulsions having silver chloride contents of 95 mol % or over, the silver halide emulsions of the layers (A) and/or (B) are spectrally sensitized for the blue light region in the grain-forming step and/or the chemically sensitizing step, to meet the following relationships:

$$1.8 \leqq BS(C) - BS(A) \leqq 2.4 \text{ and}$$

$$1.4 \leqq BS(C) - BS(B) \leqq 2.0,$$

wherein BS(A), BS(B), and BS(C) represent the blue sensitivities of the layer (A), the layer (B), and the layer (C), respectively, in terms of log (1/exposure amount) at the time when the optical density of cyan, magenta, and yellow is 1.0, and two or more silver halide emulsions are mixed in each of the layers (A) and (B) so that the gammas of the layers (A) and (B) in the photosensitive region of the layer (C) may be 0.6 to 1.3 times that of the layer (C), the gamma meaning the gradient from the optical density of 0.5 to the optical density of 1.5 in the characteristic curve.

The values, BS(C)−BS(A) and BS(C)−BS(B) in the present invention are as described above $$1.8 \leqq BS(C) - BS(A) \leqq 2.4 \text{ and}$$

$$1.4 \leqq BS(C) - BS(B) \leqq 2.0,$$

preferably $$1.8 \leqq BS(C) - BS(A) \leqq 2.3 \text{ and}$$

$$1.4 \leqq BS(C) - BS(B) \leqq 1.9,$$

more preferably $1.9 \leqq BS(C)-BS(A) \leqq 2.2$ and $1.5 \leqq BS(C)-BS(B) \leqq 1.8$, If the values of BS(C)−BS(A) and BS(C)−BS(B) are too large, the color image with subtle shade becomes flat and does not have deepness, as described above. On the other hand, if the values are too small, the saturation of color becomes low due to increase of color-mixing and the color image having inferior color reproduction is obtained.

The gammas of the layers (A) and (B) in the photosensitive region of the layer (C) may be 0.6 to 1.3 times, and preferably 0.7 to 1.2 times, more preferably 0.8 to 1.1 times, that of the layer (C). If the multiplication value of gammas is too large, the change from bright part to shaded part becomes drastic resulting in the color image with inferior gradation reproduction. On the other hand, if the value is too small, the change from bright part to shaded part becomes little resulting in the color image with flat and less modulation.

The relationships BS(C)−BS(A) and BS(C)−BS(B) and the gamma can be determined from the exposure and processing method given in Example 1. An example of the relation of sensitometry curves of yellow, magenta, and cyan that were obtained by exposing samples to light using a separation wedge, processing them, and measuring the yellow part by a densitometer is shown in FIG. 1.

The silver halide emulsions used in the present invention are silver chlorobromide emulsions having silver chloride contents of 95 mol % or over preferably 98 mol % or over. Preferably silver iodide is not contained, but if it is added, preferably the amount is no more than 1 mol %.

In these high-silver-chloride emulsions, the structure is preferably such that the silver bromide localized layer is in the layered form or non-layered form, and that it is present in the silver halide grain and/or on the surface of the silver halide grain. The halogen composition of the localized phase is preferably such that the silver bromide content is at least 10 mol %, and more preferably over 20 mol %. The localized layer may be present in the grain, or on the edges or corners of the grain surfaces, or on the planes of the grains, and a preferable example is a localized layer epitaxially grown on each corner of the grain.

The average grain size of the silver halide grains contained in the silver halide emulsions used in the present invention (the average grain size being the number average obtained by assuming the diameters of circles equivalent to the projected areas of the grains to be grain sizes) is preferably 0.1 to 2 μm.

It is preferable that their grain size distributions have a deviation coefficient (which is obtained by dividing the standard deviation of the grain size distribution by the average grain size) of 20% or less, and desirably 15% or less, that is, so-called monodisperse distributions. In this case, in order to obtain wide latitude, also preferably the above-mentioned monodisperse emulsions are blended and used in the same layer, or applied as layers one upon the other.

The shape of the silver halide grains contained in the photographic emulsions may be of a regular crystal form, such as a cubic form, a tetradecahedral form, or an octahedral form, or of an irregular crystal form, such as a spherical form or tabular form, or a composite form of these. The silver halide grains may be made up of a mixture of silver halide grains having various crystal forms In the present invention, of these, good grains are those wherein 50% or over, preferably 70 % or over, and more preferably 90% or over, have the above regular crystal form.

In addition, emulsions can also be preferably used wherein tabular grains having an average aspect ratio (in terms of circle diameter/thickness) of 5 or over, and preferably 8 or over, amount to over 50% of all the grains in terms of projected area.

The silver chlorobromide emulsions used in the present invention can be prepared by the methods described, for example, by P. Glafkides in *Chimie et Phisicue Photographique* (published by Paul Montel, 1967), by G. F. Duffin in *Photographic Emulsion Chemistry* (published by Focal Press, 1966), and by V. L. Zelikman et al. in Making and Coating Photographic Emulsion (Focal Press, 1964). That is, any method of the acid method, the neutral method, the ammonia method, etc., can be used, and as the type wherein a soluble silver salt and a soluble silver halide are reacted, any method of the single jet method, the double-jet method, a combined method of these, etc., can be used. Also the method wherein grains are formed in an atmosphere containing excess silver ions, that is, the so-called reverse precipitation method, can also be used. As one type of the double-jet method, a method wherein the pAg in the liquid phase where the silver halide is formed is kept constant, that is, the so-called controlled double jet method, can also be used. According to the controlled double jet method, a silver halide emulsion wherein the crystal form is regular and the grain size is nearly uniform can be obtained.

Into the silver halide emulsions used in the present invention can be introduced various polyvalent metal ion impurities in the process of the formation or physical ripening of the emulsion grains. Example compounds that can be used include a salt of cadmium, zinc, lead, copper, thulium, etc., and a salt or complex salt of platinum, iridium, osmium, palladium, rhodium, ruthenium, and iron that are elements of Group VIII. In particular, the above elements of Group VIII can be preferably used. The amount of these compounds to be added varies over a wide range to meet the purpose, preference being given to $10^{-9}$ to $10^{-2}$ mol per mol of the silver halide.

Generally, the silver halide emulsions used in the present invention are chemically and spectrally sensitized.

As the chemical sensitization method, sulfur sensitization that is typically carried out by the addition of an unstable sulfur compound, noble metal sensitization, typically gold sensitization, or reduction sensitization can be used alone or in combination. As the compounds used in the chemical sensitization, preferably those described in JP-A No. 215272/1987, page 18 (the right lower column) to page 22 (the right upper column), are used.

The amount of the spectrally sensitizing dye to be added is selected to be in the range of $1\times10^{-6}$ to $1\times10^{-3}$ mol per mol of the silver halide. A preferable amount to be added by which the major spectral sensitivity is obtained is from $2\times10^{-5}$ to $7\times10^{-4}$ mol, and a preferable amount to be added by which the spectral sensitivity for reproducing details faithfully is obtained is $2\times10^{-6}$ to $1\times10^{-4}$ mol.

The timing at which the spectrally sensitizing dye is added is at the grain-forming step or at the chemical-sensitizing step. If the spectrally sensitizing dye is added after the completion of the chemical sensitization or immediately before the coating step, sensitivity and gradation required for the present invention are hardly obtained. The method wherein the major spectrally sensitizing dye is added at the grain-forming step and the spectrally sensitizing dye for reproducing details is added at the chemical-sensitizing step, or the order of the addition may be reversed, is included in the scope of the present invention. Alternatively, each of them may be divided to be added at each of these steps.

To the silver halide emulsions used in the present invention, various compounds or their precursors can be added for the purpose of stabilizing the photographic performance or preventing fogging that will take place during the process of the production of the photographic material, or storage or photographic processing of the photographic material. As specific examples of these compounds, those described in the above-mentioned JP-A No. 215272/1987, pages 39 to 72, are preferably used.

The spectral sensitization is carried out for the purpose of giving spectral sensitization in a desired wavelength region to the emulsion of each layer of the present photographic material. In the present invention, it is preferably carried out by adding a spectrally sensitizing dye, that is, a dye capable of absorbing light in the wavelength region corresponding to the intended spectral sensitization. As the spectrally sensitizing dye used at that time, for example, those described by F. M. Harmer in *Heterocyclic compounds—Cyanine dyes and related compounds,* [published by John Wiley & Sons (New York, London), 1964] can be mentioned.

Specific compound examples are given below:

S-1

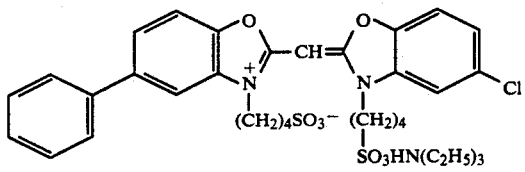

S-2

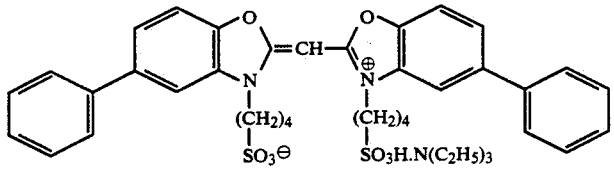

S-3

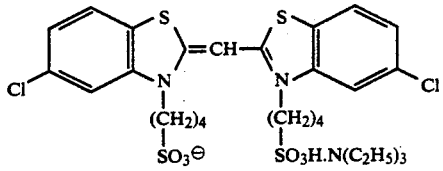

S-4

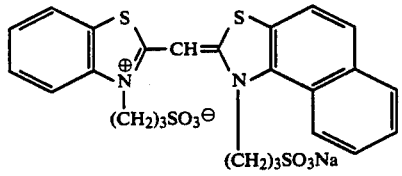

S-5

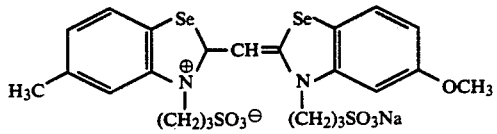

S-6

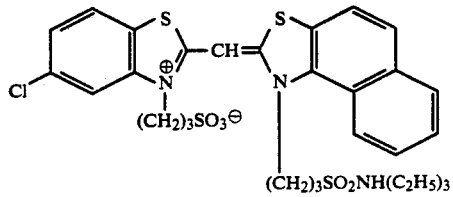

-continued
S-7
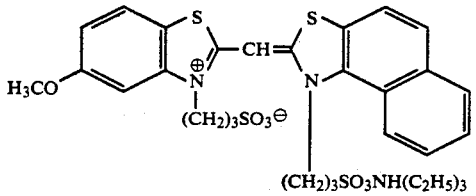
S-8
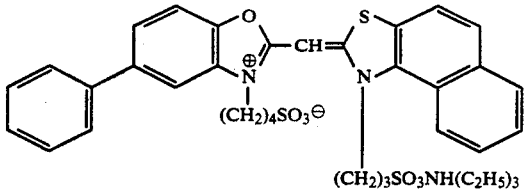
S-9
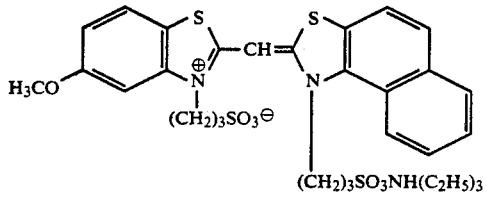
S-10
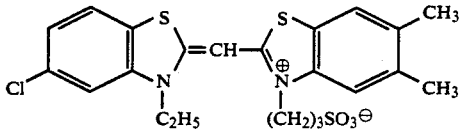
S-11
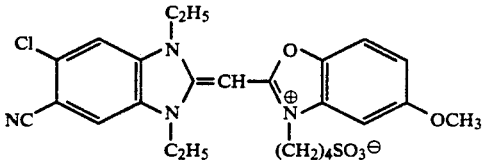
S-12
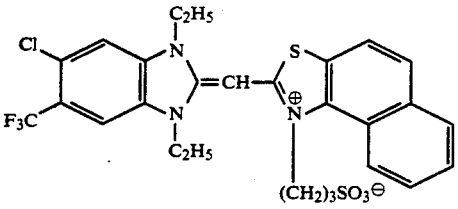
S-13
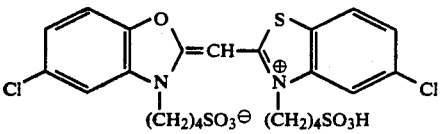
S-14
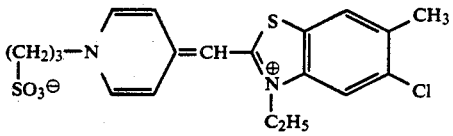
S-15
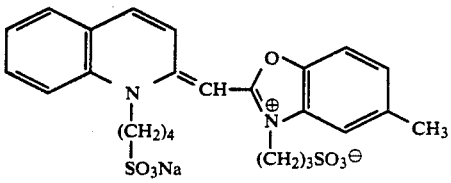

-continued
S-16
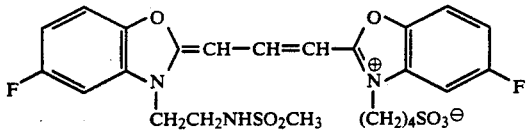
S-17
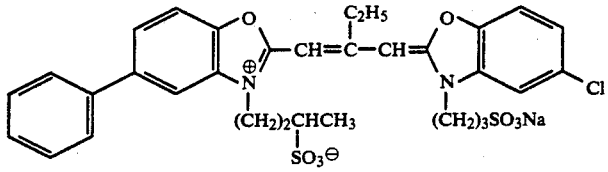
S-18
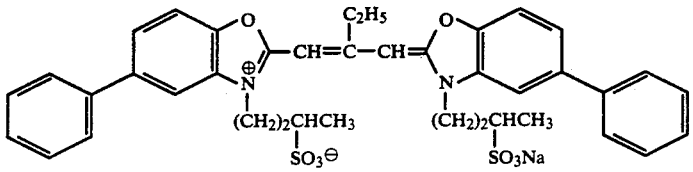
S-19
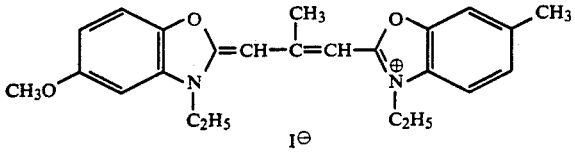
S-20
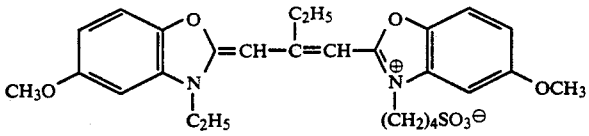
S-21
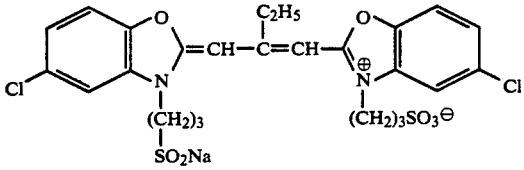
S-22
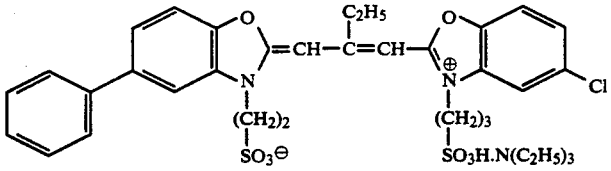
S-23
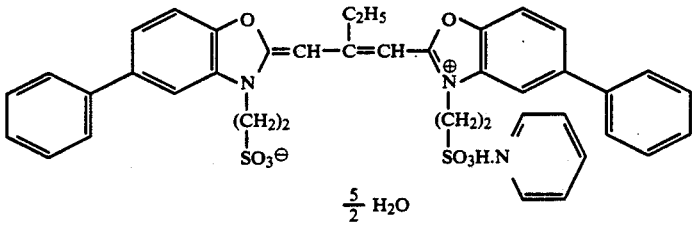
S-24
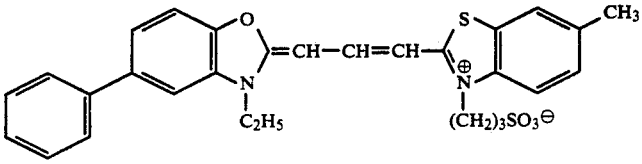

-continued
S-25
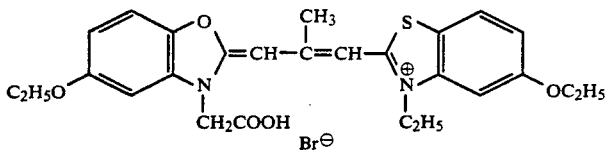
S-26
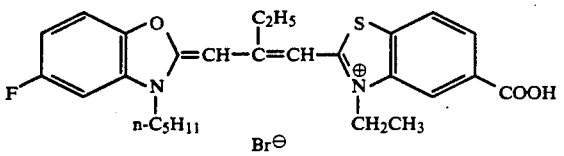
S-27
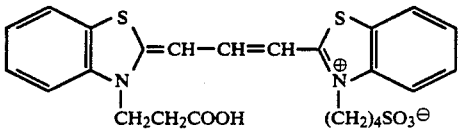
S-28
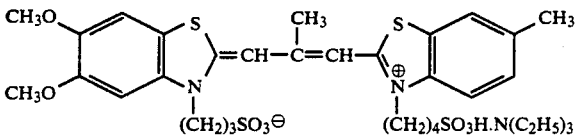
S-29
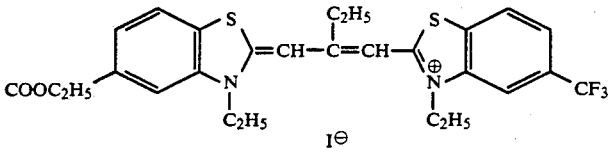
S-30
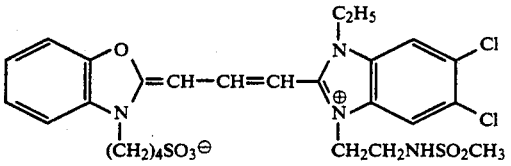
S-31
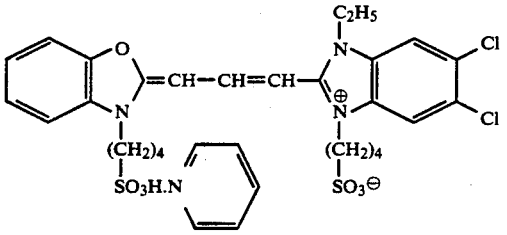
S-32
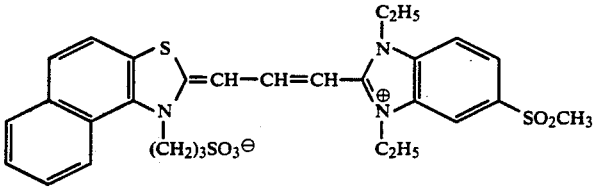
S-33
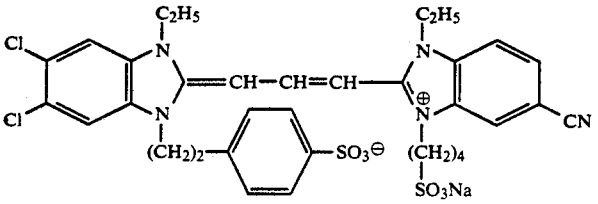

-continued
S-34
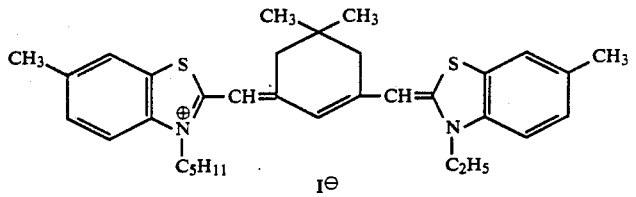
S-35
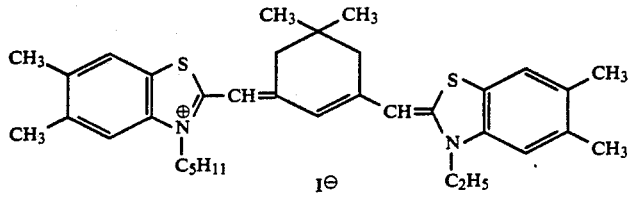
S-36
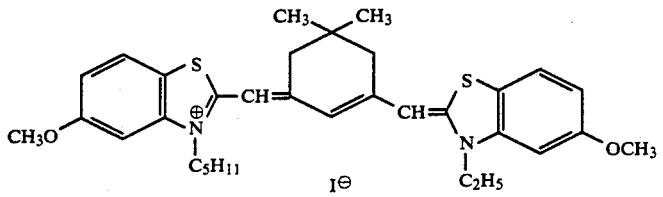
S-37
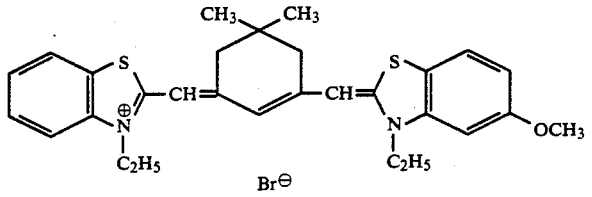
S-38
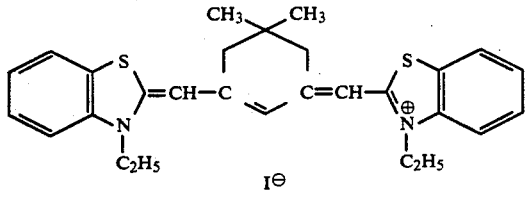
S-39
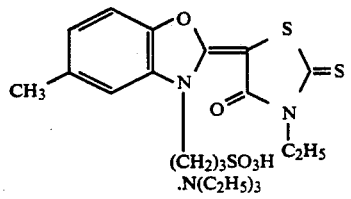
S-40
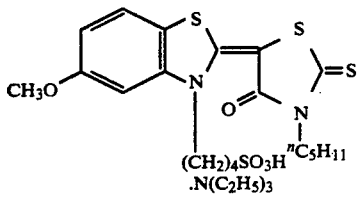
S-41
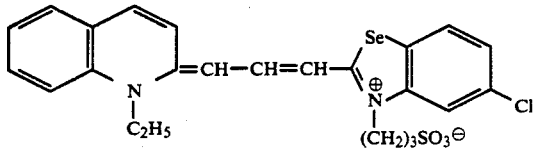

-continued
S-42
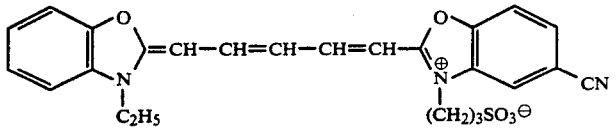
S-43
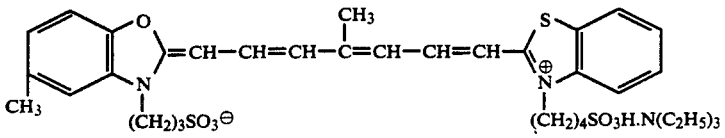
S-44
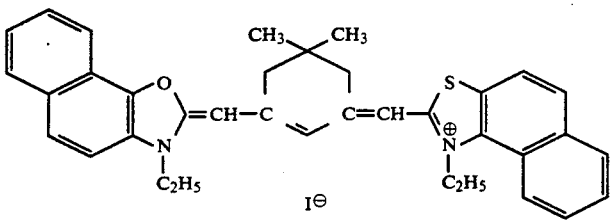
S-45
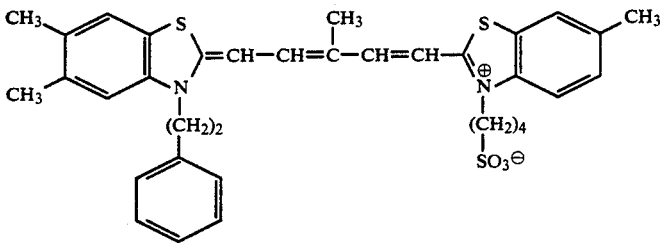
S-46
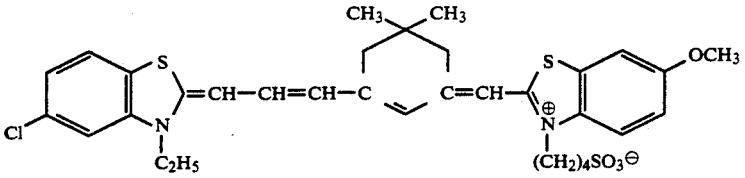
S-47
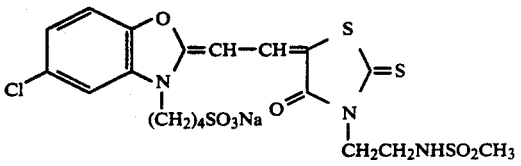
S-48
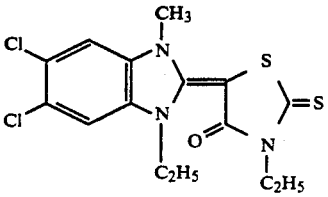

-continued
S-49
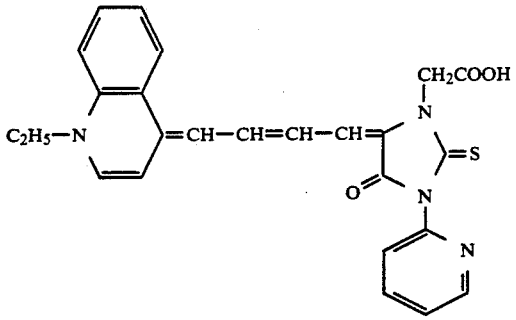
S-50
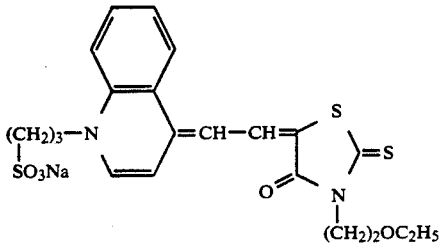
S-51
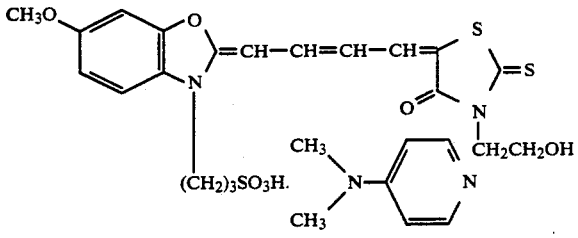
S-52
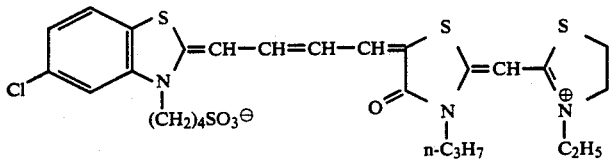
S-53
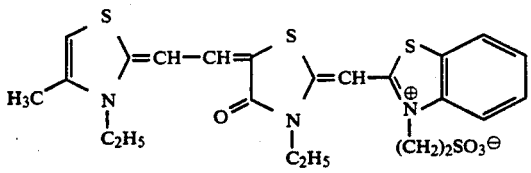
S-54
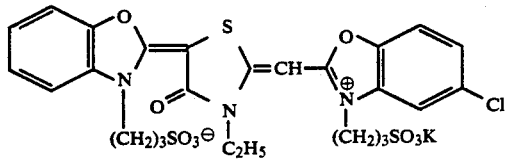
S-55
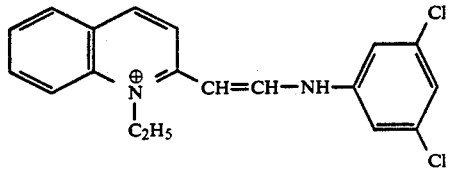

-continued

S-56

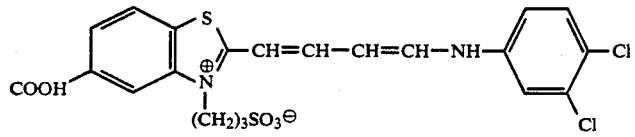

S-57

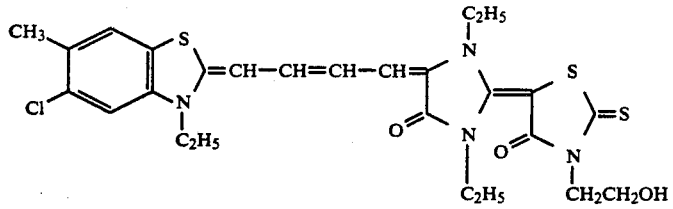

S-58

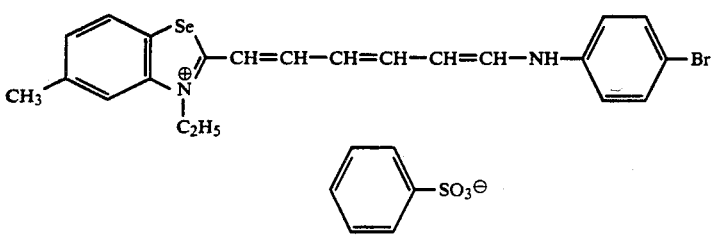

S-59

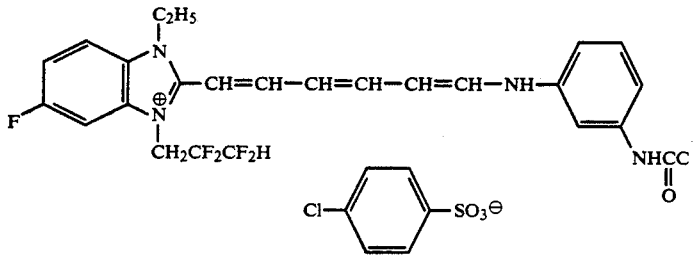

S-60

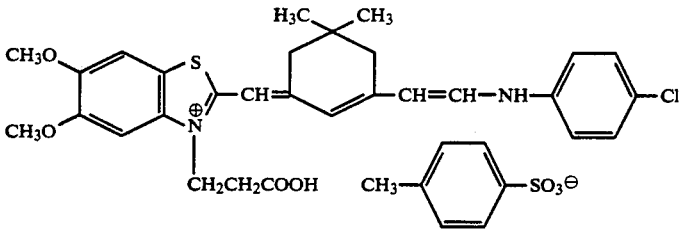

Preferably two or more emulsions are mixed in each of the emulsion layers so that the gammas of the layer (A) and the layer (B) in the photosensitive region of the layer (C) may be 0.8 to 1.2 times that of the layer (C).

To adjust the gamma as mentioned above, it may be carried out, for example, by mixing emulsions different in sensitivity.

To spectrally sensitize the silver halide emulsions of the layers (A) and (B) for the wavelength of blue, the same blue-sensitizing dye as that used for the spectral sensitization of the layer (C) may be used, or a blue-sensitizing dye different therefrom may be used.

The emulsions used in the present invention may be of any type of the so-called surface latent image type emulsion, wherein a latent image is formed mainly on the grain surfaces, and the so-called internal latent image type emulsion, wherein a latent image is formed mainly within the grains.

In the color photographic material, generally, a yellow coupler, a magenta coupler, and a cyan coupler, which will couple with the oxidized product of an aromatic amine color-developing agent to respectively form yellow, magenta, and cyan, are used.

Cyan couplers, magenta couplers, and yellow couplers preferably used in the present invention are those represented by the following formulae (C-1), (C-II), (M-I), (M-II), and (Y):

Formula (C-I)

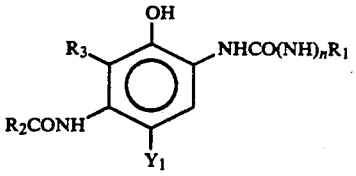

Formula (C-II)

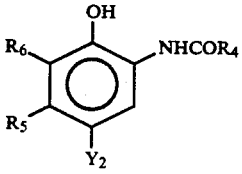

-continued

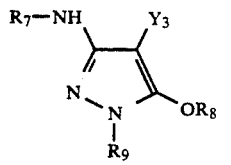

Formula (M-I)

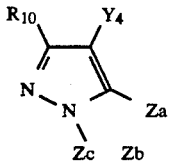

Formula (M-II)

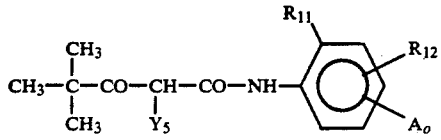

Formula (Y)

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_5$ is an alkyl group having 2 to 15 carbon atoms, or a methyl group substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897

In formula (M-II), $R_{10}$ represents a hydrogen atom or a substituent. $Y_4$ represents a hydrogen atom or a group capable of being released upon coupling reaction, and particularly preferably a halogen atom or an arylthio group. Za, Zb, and Zc each represent methine, a substituted methine, =N—, or —NH—, and one of the Za—Zb bond and the Zb—Zc bond is a double bond, and the other is a single bond. If the Zb—Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. $A_O$ represents $-NHCOR_{13}$, $-NHSO_2-R_3$, $$-SO_2NHR_{13},\ -COOR_{13},\ \text{or}\ -SO_2\underset{\underset{R_{14}}{|}}{N}-R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.
Specific examples of couplers represented by formulae (C-I), (C-II), (M-I), (M-II) and (Y) are listed below.
(C-1)
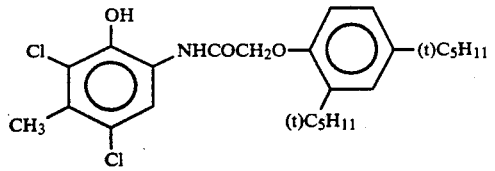
(C-2)
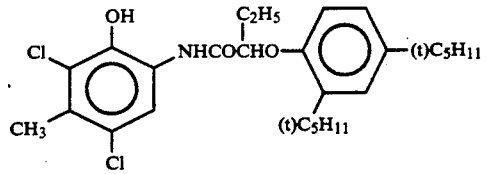
(C-3)
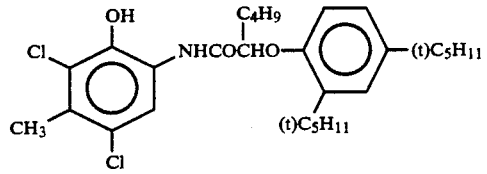
(C-4)
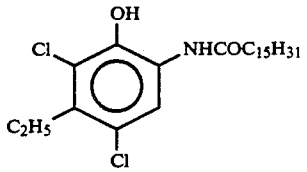
(C-5)
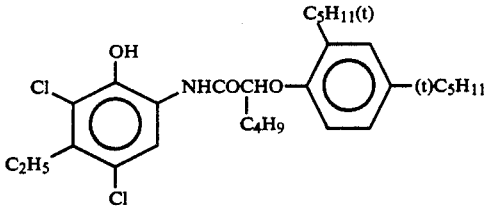
(C-6)
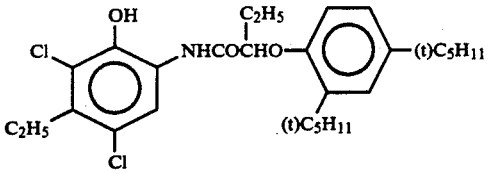
(C-7)
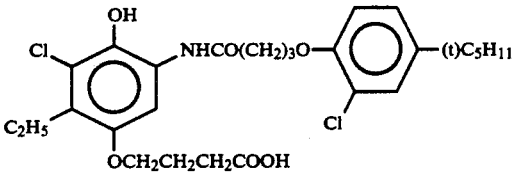
(C-8)
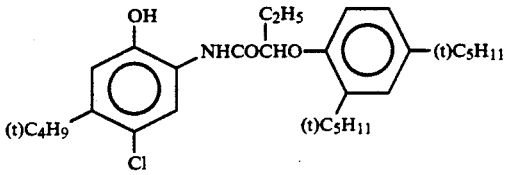

-continued
(C-9)
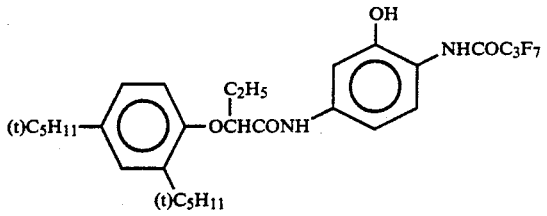
(C-10)
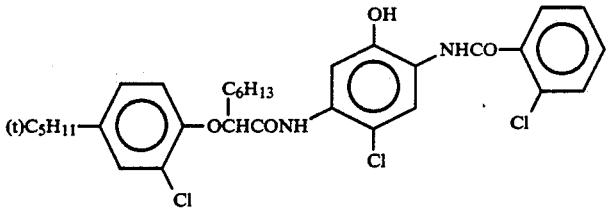
(C-11)
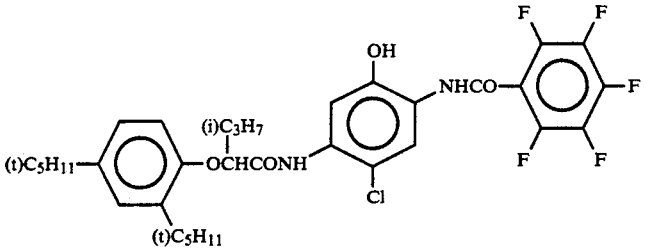
(C-12)
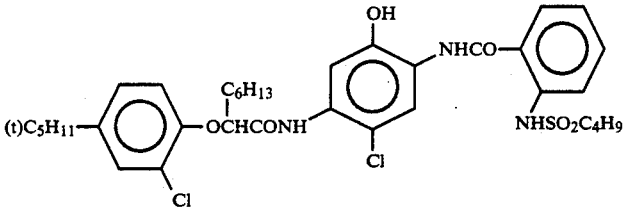
(C-13)
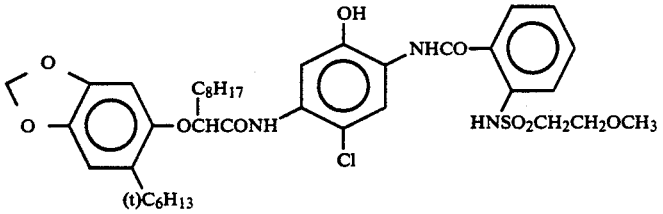
(C-14)
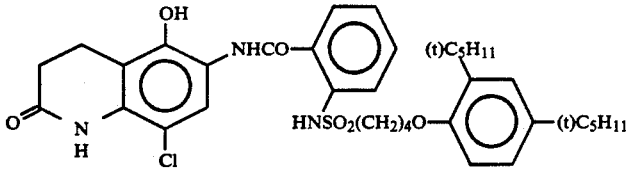
(C-15)
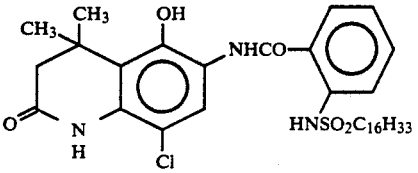

-continued
(C-16)
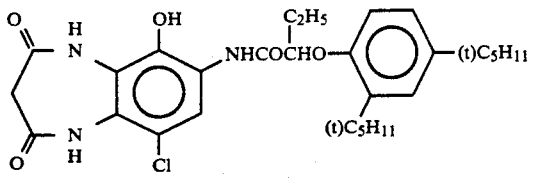
(C-17)
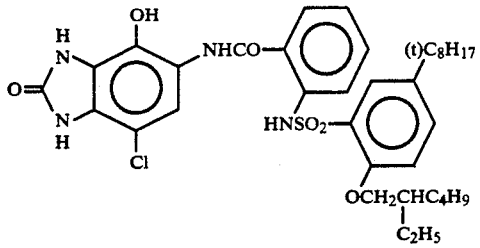
(C-18)
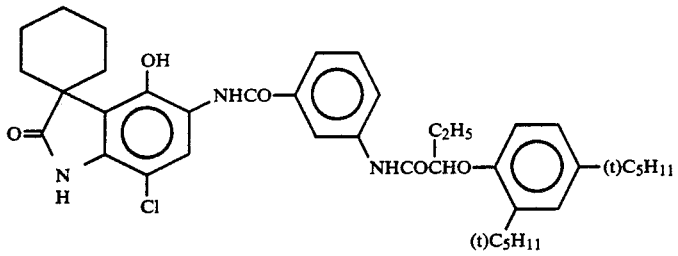
(C-19)
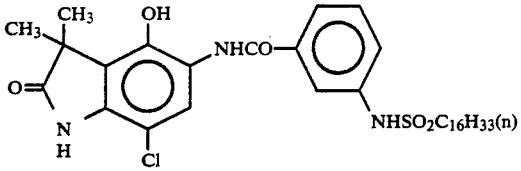
(C-20)
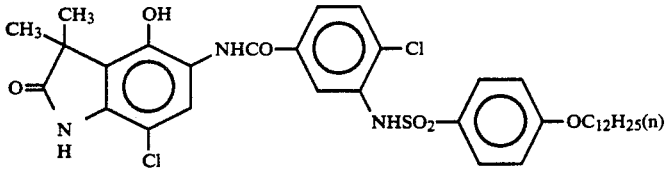
(C-21)
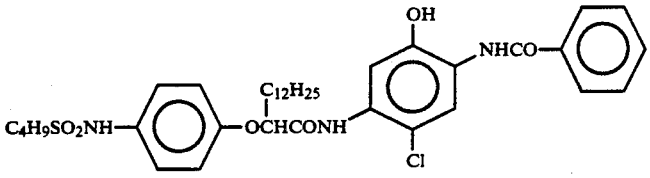
(C-22)
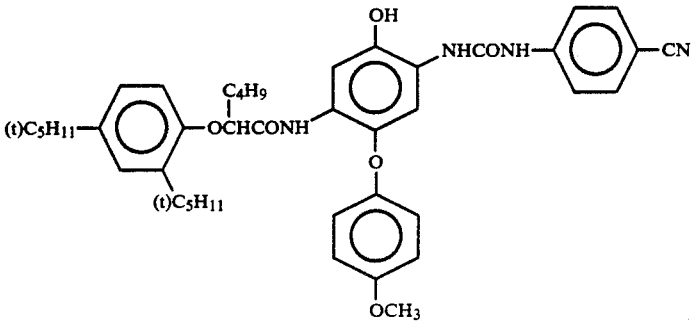

-continued
(M-1)
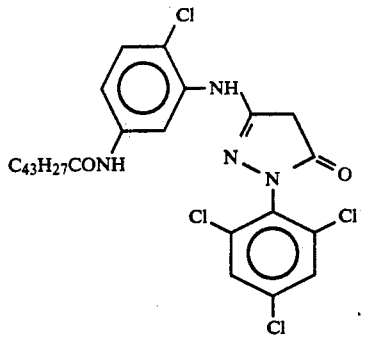
(M-2)
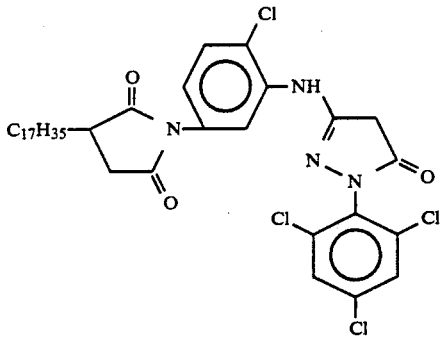
(M-3)
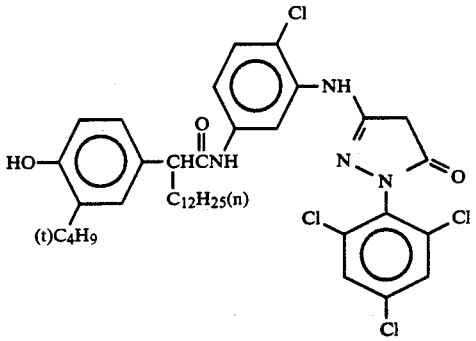
(M-4)
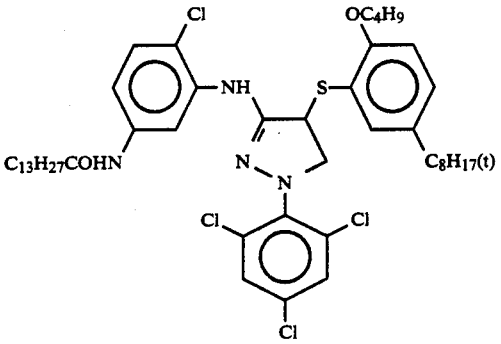

-continued
(M-5)
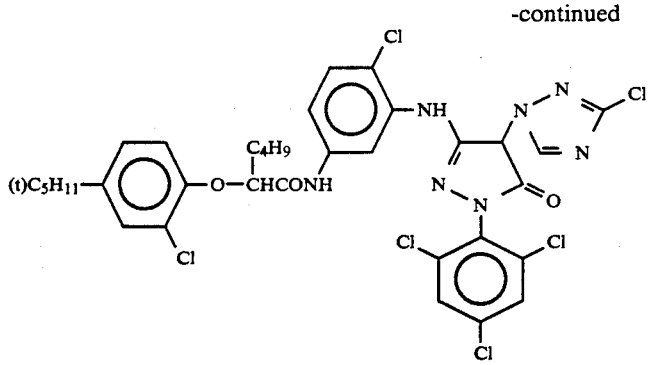
(M-6)
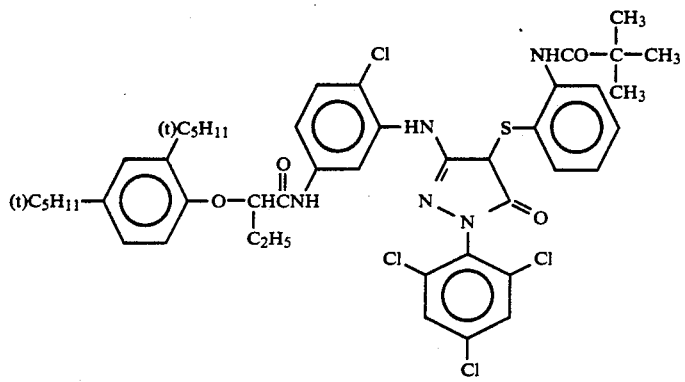
(M-7)
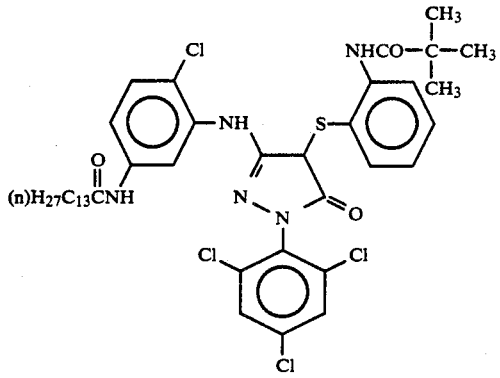
(M-8)
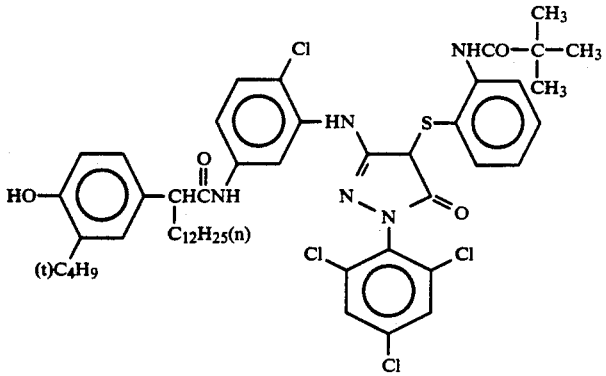

| Compound | $R_{10}$ | $R_{15}$ | $Y_4$ |
|---|---|---|---|
| | | 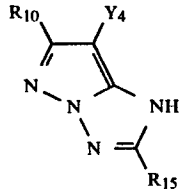 | |
| M-9 | $CH_3$— | 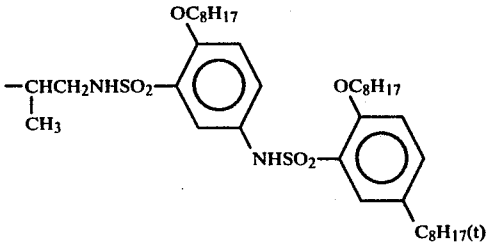 | Cl |
| M-10 | The same as the above | 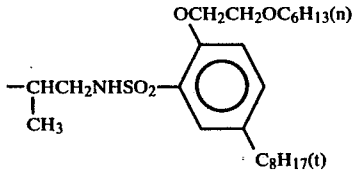 | The same as the above |
| M-11 | $(CH_3)_3C$— | 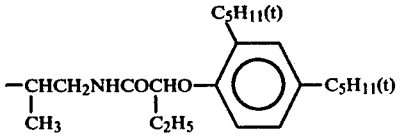 | 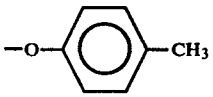 |
| M-12 | 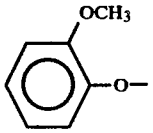 | 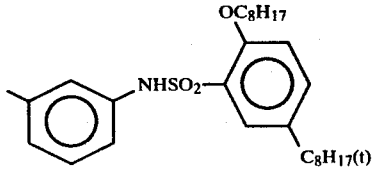 | 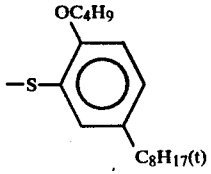 |

-continued
| Compound | $R_{10}$ | $R_{15}$ | $Y_4$ |
|---|---|---|---|
| M-13 | $CH_3$— | 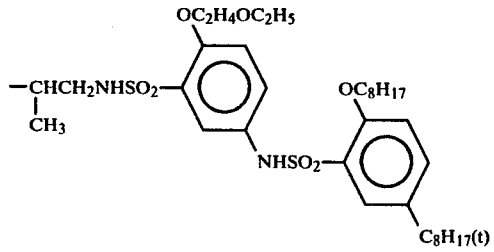 | Cl |
| M-14 | The same as the above | 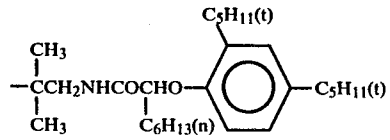 | The same as the above |
| M-15 | The same as the above | 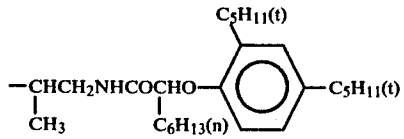 | The same as the above |
| M-16 | The same as the above | 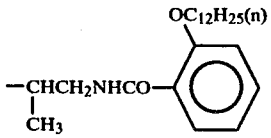 | The same as the above |
| M-17 | The same as the above | 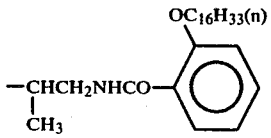 | The same as the above |

-continued
| Compound | $R_{10}$ | $R_{15}$ | $Y_4$ |
|---|---|---|---|
| M-18 | 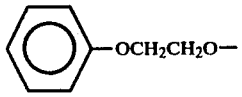 | 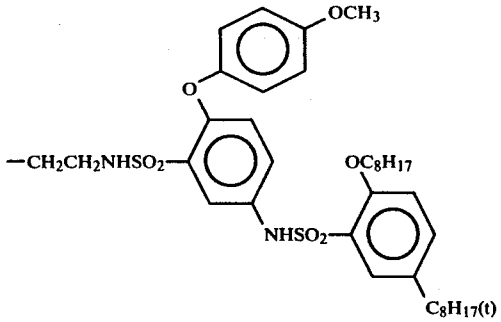 | 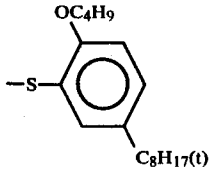 |
| M-19 | $CH_3CH_2O-$ | The same as the above | The same as the above |
| M-20 | 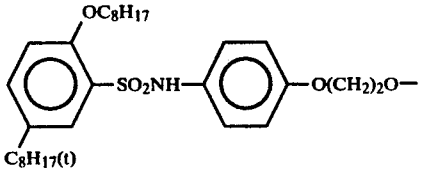 | 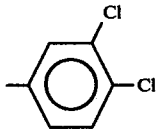 | 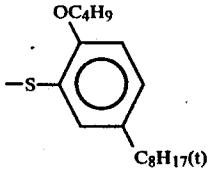 |
| M-21 | 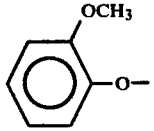 | 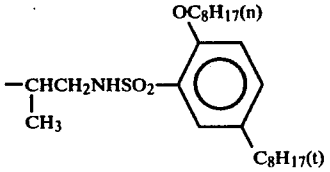 | Cl |
| | 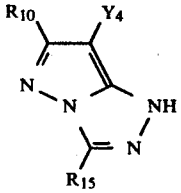 | | |
| M-22 | $CH_3-$ | 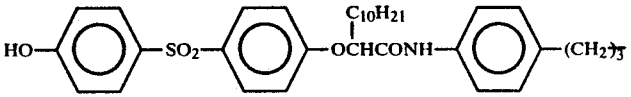 | Cl |

-continued

| Compound | $R_{10}$ | $R_{15}$ | $Y_4$ |
|---|---|---|---|
| M-23 | The same as the above | $(n)C_6H_{13}$ $CHCH_2SO_2-(CH_2)_2$ $(n)C_8H_{17}$ | The same as the above |
| M-24 | $CH_3$ $CH-$ $CH_3$ | $OC_4H_9$ $-SO_2-(CH_2)_3$ $C_8H_{17}(t)$ | The same as the above |
| M-25 | $\underset{COOCH_2CH_2OCH_3}{(CH-CH_2)_{50}}\underset{CONH-}{(CH_2-\overset{CH_3}{C})_{50}}$ | $CH_3-\underset{CH_2NHSO_2CH_3}{CH}-$ | The same as the above |
| M-26 | $-O-$ | $OC_8H_{17}$ $(CH_2)_2NHSO_2-$ $C_8H_{17}(t)$ | The same as the above |
| M-27 | $CH_3-$ | $CH_3$ $CH_3$ $CH_3$ $NHCOCHO-$ $(n)C_{10}H_{21}$ $-SO_2-$ $-OCH_2-$ | Cl |
| M-28 | $(CH_3)_3C-$ | $CH_3$ $CH_3$ $CH_3$ $C_5H_{11}(t)$ $NHCOCHO-$ $C_4H_9(n)$ $-C_5H_{11}(t)$ | The same as the above |

-continued
| Compound | $R_{10}$ | $R_{15}$ | $Y_4$ |
|---|---|---|---|
| M-29 | 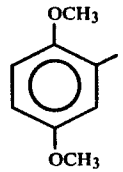 | 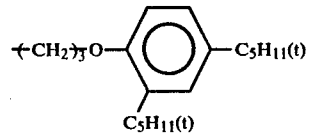 | The same as the above |
| M-30 | $CH_3-$ | $(n)C_{10}H_{37}$<br>$-CH-NCOCH_2CH_2COOH$<br>$C_2H_5$ | The same as the above |

(Y-1)
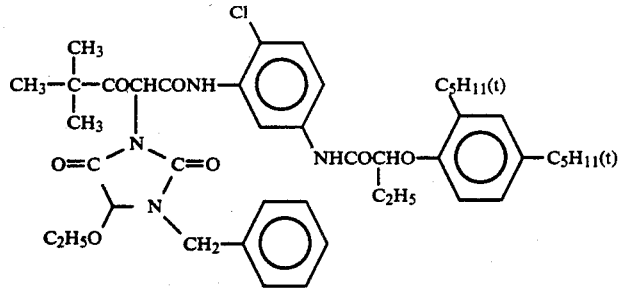
(Y-2)
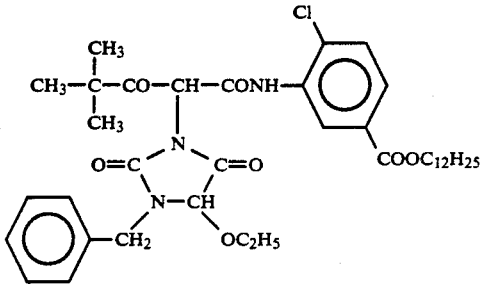
(Y-3)
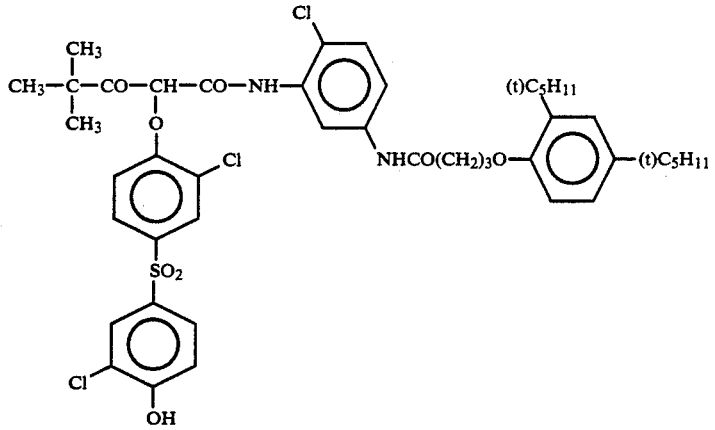
(Y-4)
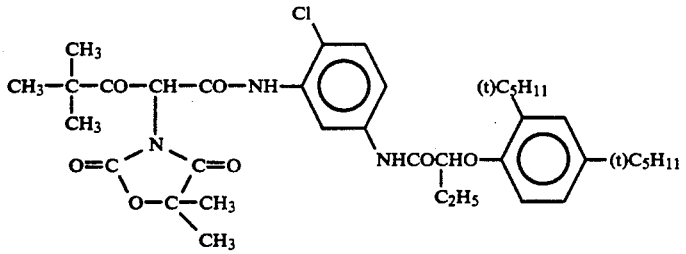
(Y-5)
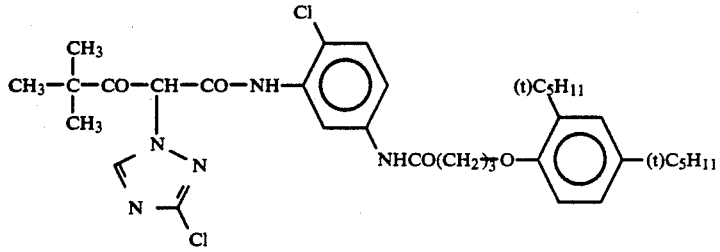

-continued (Y-6)

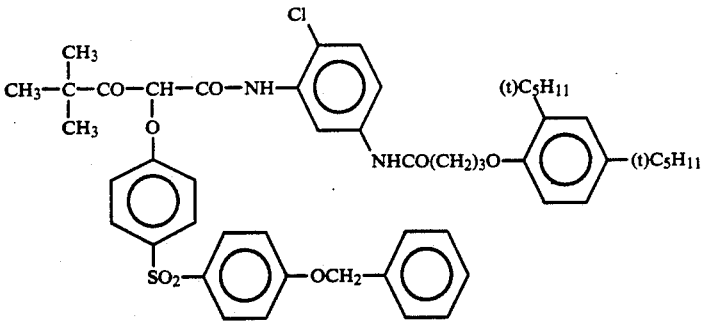

(Y-7)

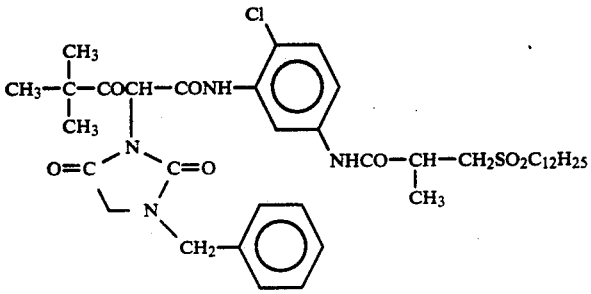

(Y-8)

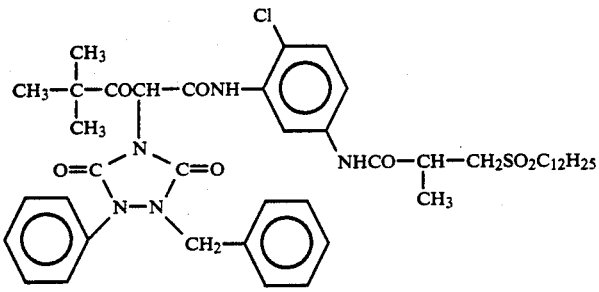

(Y-9)

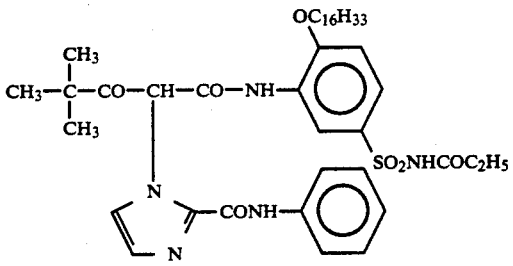

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A'), (B'), (C'), (D'), or (E') is preferably used.

Formula (A')

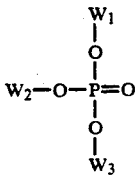

-continued $W_1—COO—W_2$ Formula (B')

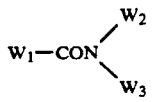

Formula (C')

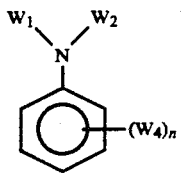

Formula (D')

$W_1—O—W_2$ Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or S-$W_1$, n is an integer of 1 to 5, when n is 2 or over, $W_4$ groups may be the same or different, and in formula (E'), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, mathylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 l/mol·sec to $1\times10^{-5}$ l/mol·sec. The second-order reaction- specific rate can be determined by the method described in JP-A No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

Formula (FI)

$$R'_1-(A_1)_n-X$$

Formula (FII)

$$R_2'-\underset{\underset{B_1}{|}}{C}=Y$$

wherein $R'_1$ and $R'_2$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R'_1$ and X, or Y and $R'_2$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

Formula (GI)

$$R'_3-Z$$

wherein $R'_3$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^nCH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987, 229145/1987, 230039/1989, and 57259/1989, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 $\mu m \times 6\ \mu$, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient s/R can be obtained by $$\sqrt{\frac{\sum_{i=1}^{n}(R_i-\overline{R})^2}{n-1}} \Big/ \frac{\sum_{i=1}^{n} R_i}{n}.$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

It is preferable that the present color photographic material is color-developed, bleach-fixed, and washed (or stabilized). The bleach and the fixing may not be effected in the single bath described above, but may be effected separately.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyeth-yl)amino]aniline
D-5: 2-methyl-4-[N-ethyl-N-(β-hydroxyethyl)amino]-aniline
D-6: 4-amino-3-methyl-N-ethyl-N-[β-(methane-sulfonamido)ethyl]-aniline
D-7: N-(2-amino-5-diethylaminophenylethyl)-methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methane-sulfonamido)ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0\times10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0\times10^{-3}$ mol/l or below, and most preferably hydroxylamine is not contained at all.

It is preferable that the developer used in the present invention contains an organic preservative instead of hydroxylamine or sulfite ions, in that process color-contamination and fluctuation of the photographic quality in continuous processing can be suppressed.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color-developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos. 4235/1988, 30845/1988, 21647/1988, 44655/1988, 5355/1988, 43140/1988, 56654/1988, 58346/1988, 43138/1988, 146041/1988, 170642/1988, 44657/1988, and 44656/1988, U.S. Pat. Nos. 3,615,503 and 2,494,903, JP-A No. 143020/1977, and JP-B 30496/1973.

As the other preservative, various metals described, for example, in JP-A Nos. 44148/1982 and 53749/1982, salicylic acids described, for example, in JP-A No. 180588/1984, alkanolamines described, for example, in JP-A No. 3532/1979, polyethyleneimines describe example, in JP-A No. 94349/1981, aromatic polyhydroxyl compounds described, for example, in U.S. Pat. No. 3,746,544 may be included, if needed. It is particularly preferable the addition of alkanolamines such as triethanolamine, dialkylhydroxylamines such as diethylhydroxylamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in Japanese Patent Application Nos. 255270/1987, 9713/1988, 9414/1988, and 11300/1988.

The use of amines in combination with the above-mentioned hydroxylamine derivatives or hydrazine derivatives is preferable in view of stability improvement of the color developer resulting its stability improvement during the continuous processing.

As the example of the above-mentioned amines cyclic amines described, for example, in JP-A No. 239447/1988, amines described, for example, in JP-A No. 128340/1988, and amines described, for example, in Japanese Patent Application Nos. 9713/1988 and 11300/1988.

In the present invention, it is preferable that the color developer contains chloride ions in an amount of $3.5\times10^{-2}$ to $1.5\times10^{-1}$ mol/l, more preferably $4\times10^{-2}$ to $1\times10^{-1}$ mol/l; If the concentration of ions exceeds $1.5\times10^{-1}$ mol/l, it is not preferable that the development is made disadvantageously slow, not leading to attainment of the objects of the present invention such as rapid processing and high density. On the other hand, if the concentration of chloride ions is less than $3.5\times10^{-2}$ mol/l, fogging is not prevented.

In the present invention, the color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l, most preferably $1.0\times10^{-4}$ to $3.0\times10^{-4}$ mol/l. If the concentration of bromide ions is more than $1.0\times10$ mol/l, the development is made slow., the maximum density and the sensitivity are made low, and if the concentration of bromide ions is less than $3.0\times10^{-5}$ mol/l, fogging is not prevented sufficiently.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In order to keep the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering they do not adversely affect the photographic function (for example, to cause fogging), and they are inexpensive. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l;, and particularly preferably 0.1 to 0.4 mol/l.

In addition to the color developer can be added various chelating agents to prevent calcium or magnesium from precipitating or to improve the stability of the color developer. As the example of chelating agents can be mentioned nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic-acid, and N,N'-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethyl-benzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention is 20 to 50° C., and preferably 30 to 40° C. The processing time is 20 sec to 5 min, and preferably 30 sec to 2 min. Although it is preferable that the replenishing amount is as-small as possible, it is suitable that the replenishing amount is 20 to 600 ml, preferably 50 to 300 ml, more preferably 60 to 200 ml, and most preferably 60 to 150 ml, per square meter of the photographic material.

The desilvering step in the present invention will now be described. Generally the desilvering step may comprise, for example, any of the following steps: a bleaching step—a fixing step; a fixing step—a bleach— fixing step; a bleaching step—a bleach-fixing step; and a bleach-fixing step.

Next, the bleaching solution, the bleach-fixing solution, and the fixing solution that are used in the present invention will be described.

As the bleaching agent used in the bleaching solution or the bleach-fixing solution used in present invention, use is made of any bleaching agents, but particularly it is preferable to use organic complex salts of iron(III) (e.g., complex salts of aminopolycarboxylic acids, such as ethylenediaminetetraacetic acid, and diethylenetriaminepentaacetic acid, aminopolyphosphonic acids, phosphonocarboxylic acids, and organic phosphonic acids); organic acids, such as citric acid, tartaric acid, and malic acid; persulfates; and hydrogen peroxide.

Of these, organic complex salts of iron(III) are particularly preferable in view of-the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium. Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleaching solution, the bleach-fix solution, and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and Research Disclosure No. 17129 (July 1978), thiourea compounds described, for example, in JP-B No. 8506/1970, JP-A Nos. 20832/1977 and 32735/1978, and U.S. Pat. No. 3,706,561, or halides such as iodides and bromides, which are preferable because of their excellent bleaching power.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 3 to 10, and particularly preferably 5 to 9.

Further, the bleach-fixing solution may additionally contain various brightening agents, anti-foaming agents, surface-active agents, polyvinyl pyrrolidone, and organic solvents, such as methanol.

The bleach-fixing solution or the fixing solution contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic-material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing-calcium and magnesium described in JP-A No. 131632/1986 can be used quite effectively. Further, isothiazolone compounds and described in JP-A No. 8542/1982, chlorine-thiabendazoles type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kaqaku, Biseibutsu no Genkin, Sakkin, Bobai Gijutsu* (edited by Eiseigijutsu-kai), and *Bokin Bobai-zai Jiten* (edited by Nihon Bokin Bobaigakkai), can be used.

Further, the washing water can contain surface-active agents as a water draining agent, and chelating agents such as EDTA as a water softener.

After the washing step mentioned above, or without the washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 220345/1985, can be used.

Further, chelating agents, such as 1-hydroxyethylidene-1,1-diphosphonic acid, and ethylenediaminetetramethylenephosphonic acid, and magnesium and bismuth compounds can also be used in preferable modes.

A so-called rinse can also be used as a washing solution or a stabilizing solution, used after the desilverization.

The pH of the washing step or a stabilizing step is preferably 4 to 10, more preferably 5 to 8. The temperature will vary depending, for example, on the application and the characteristics of the photographic material, and it generally will be 15 to 45° C., and preferably 20 to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in the discharge, and the handleability.

According to the present invention an excellent silver halide photographic material can be provided, that is excellent in rapid processability, that can attain high sensitivity and high contrast, and wherein the fluctuation of sensitivity due to a change of temperature or illuminance at the time of exposure is less, and desensitization that can be caused by application of pressure is less.

By practicing the present invention, a silver halide color photographic material that can give an image excellent in color reproduction and gradation reproduction can be provided. In particular, there can be provided a silver halide color photographic material which can form a color image giving a stereoscopic feeling that can reproduce bright primary colors less in turbidity over the range from the low-density part to the high-density part, and which can produce fully the high-density region of primary colors with subtle shades.

Next, the present invention will be described in detail in accordance with examples, but the invention is not limited to these Examples.

EXAMPLE 1

A multilayer photographic material was prepared by multi-coatings composed of the following layer composition on a two-side polyethylene laminated paper support. Coating solutions were prepared as follows:

Preparation of the first coating solution

To a mixture of 19.1 g of yellow coupler (ExY), 4.4 g of image-dye stabilizer (Cpd-1) and 0.7 g of image dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3 : 7 (silver mol ratio) blend of grains having 0.88 μm and 0.7 μm of average grain size, and 0.08 and 0.10 of deviation coefficient of grain size distribution, respectively, each in which 0.2 mol % of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used: Blue-sensitive emulsion layer:

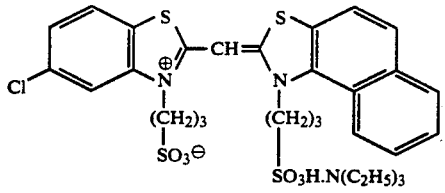

and

-continued

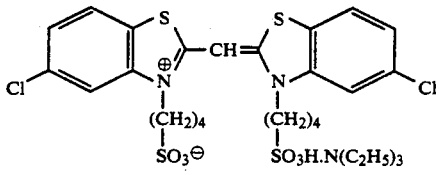

(each $2.0\times10^{-4}$ mol to the large size emulsion and $2.5\times10^{-4}$ mol to the small size emulsion, permol of silver halide.)

Green-sensitive emulsion layer:

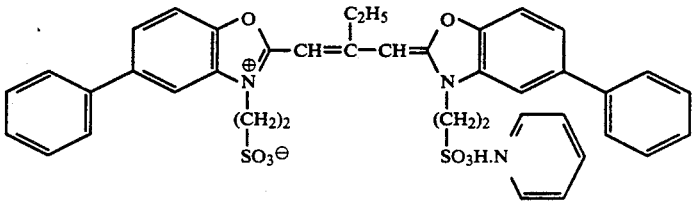

($4.0\times10^{-4}$ mol to the large size emulsion and $5.6\times10^{-4}$ mol to the small size emulsion, per mol of silver halide) and

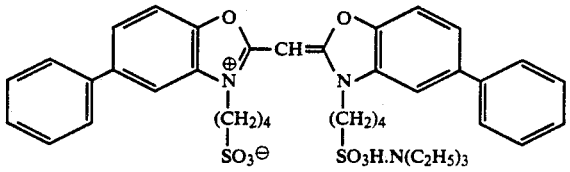

($7.0\times10^{-5}$ mol to the large size emulsion and $1.0\times10^{-5}$ mol to the small size emulsion, per mol of silver halide)

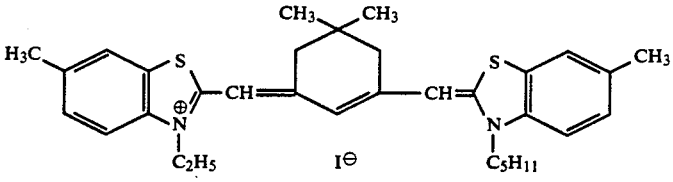

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

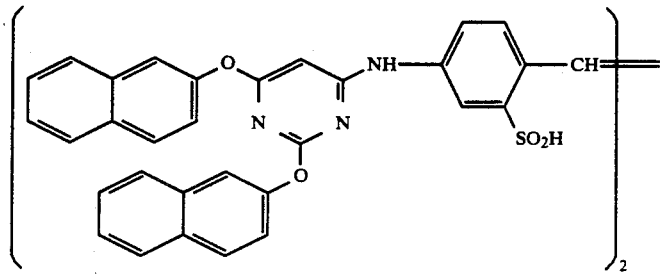

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol, $2\times10^{-4}$ mol, per mol of silver halide, respectively.

The dyes shown below were added to the emulsion layers for prevention of irradiation.

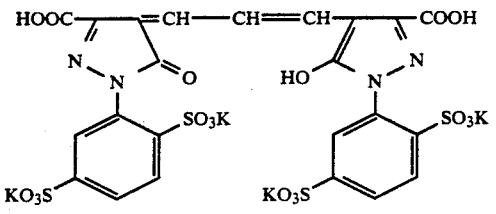

and

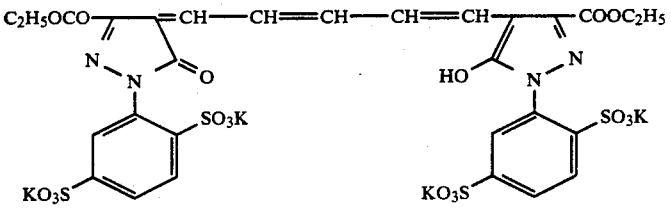

Composition of Layers

The composition of each layer is shown below. The figures represent coating amount (g/m²). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

-continued
R = 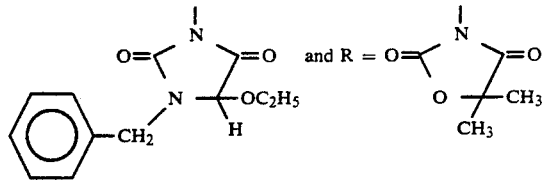 and R = 
of the following formula
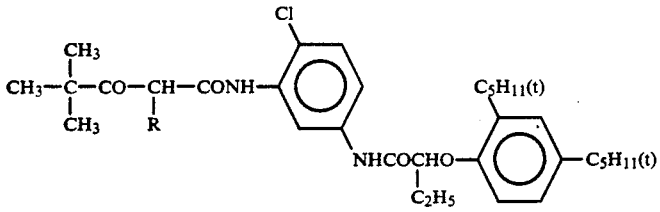
(ExM) Magenta coupler
Mixture (1:1 in molar ratio) of
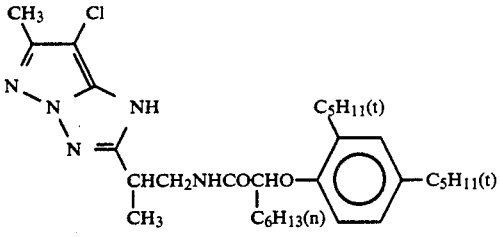
and
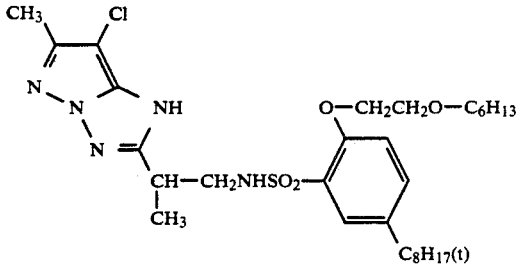
(ExC) Cyan coupler
Mixture (2:4:4 in weight ratio) of
R = $C_2H_5$ and $C_4H_9$ of
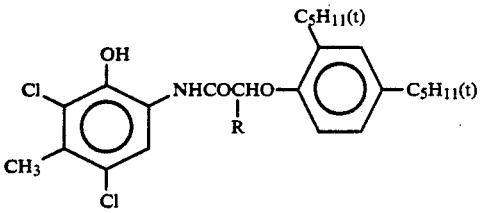
and
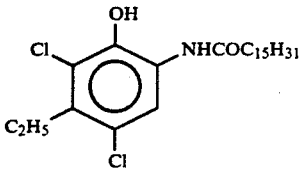
(Cpd-1) Image-dye stabilizer -continued
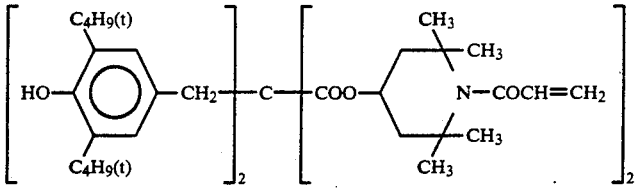
(Cpd-2) Image-dye stabilizer
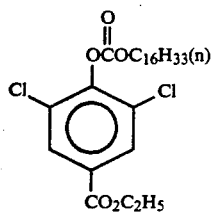
(Cpd-3) Image-dye stabilizer
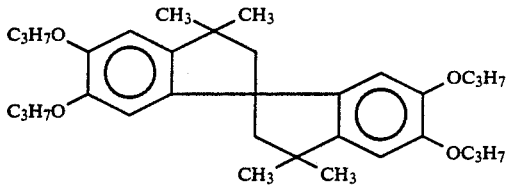
(Cpd-4) Image-dye stabilizer
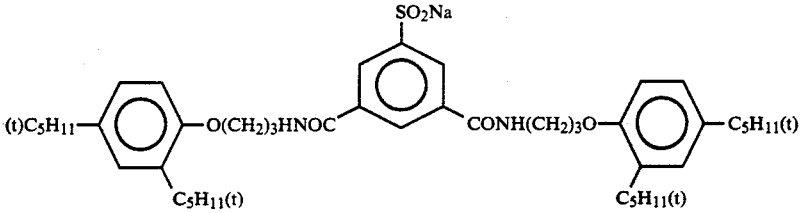
(Cpd-5) Color-mix inhibitor
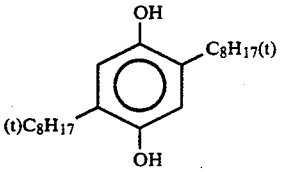
(Cpd-6) Image-dye stabilizer
Mixture (2:4:4 in weight ratio) of
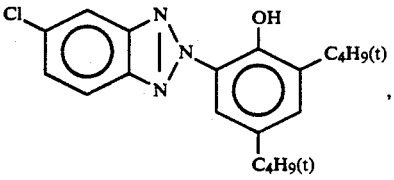
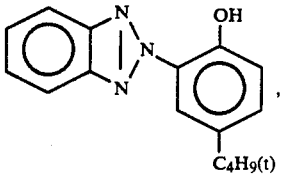
and -continued
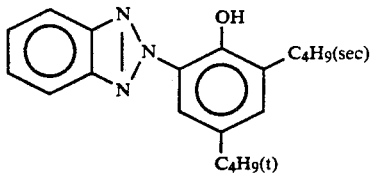
(Cpd-7) Image-dye stabilizer
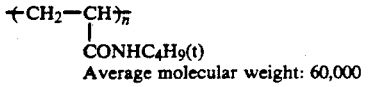
Average molecular weight: 60,000
(Cpd-8) Image-dye stabilizer
Mixture (1:1 in weight ratio) of
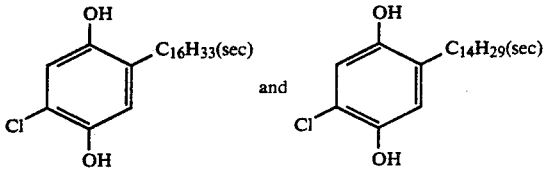
(Cpd-9) Image-dye stabilizer
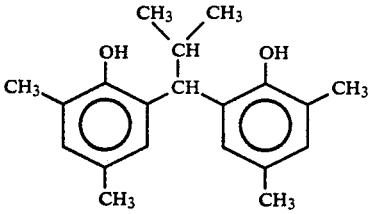
(UV-1) Ultraviolet ray absorber
Mixture (4:2:4 in weight ratio) of
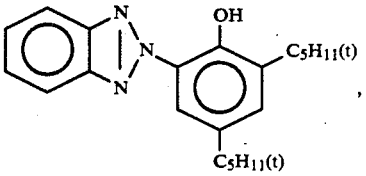
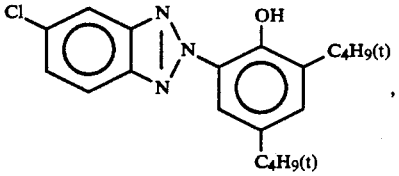
and
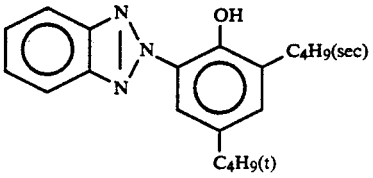
(Solv-1) Solvent -continued

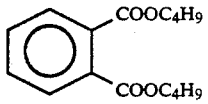

(Solv-2) Solvent
Mixture (2:1 in volume ratio) of

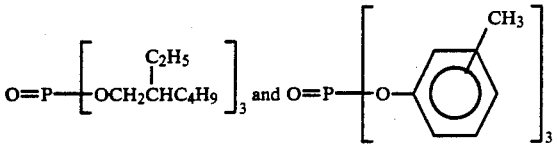

(Solv-4) Solvent

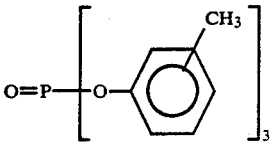

(Solv-5) Solvent

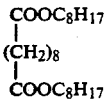

(Solv-6) Solvent

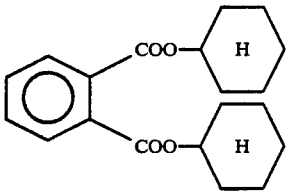

In the above procedure, the addition of sensitizing dye was effected at the chemical sensitizing step in the cases of blue-sensitive layer and red-sensitive layer and at the grain-forming step in the case of grain-sensitive emulsion layer. Samples (101) to (117) were prepared by adding exemplified compound (S-6)of sensitizing dye to the green-sensitive layer and red-sensitive layer during the chemical sensitizing step.

Each of Samples (101) to (117) was subjected to a gradation exposure through three color separated filters for sensitometry (blue:TB-5, green: TG-5, and red: TR-5 filters, made by Fuji Photo Film Co., Ltd.) using a sensitometer (FWH model made by Fuji Photo Film Co., Ltd., the color temperature of light source was 3200 K). At that time, the exposure was carried out in such a manner that the exposure was 250 CMS with the exposure time being 0.1 sec. After exposure to light each sample was subjected to a processing by the processing process shown below using an automatic processor.

Composition, sensitivity difference, and gamma ratio of each sample are shown in Table 1.

Next, color reproduction quality and detail reproduction property of samples (101) to (117) were evaulated by printing a negative for practical use.

| Processing step | Temperature | Time | Replenisher* | Tank Volume |
|---|---|---|---|---|
| Color development | 35° C. | 45 sec. | 161 ml | 17 l |
| Bleach-fixing | 30–35° C. | 45 sec. | 215 ml | 17 l |
| Rinsing ① | 30–35° C. | 20 sec. | — | 10 l |
| Rinsing ② | 30–35° C. | 20 sec. | — | 10 l |
| Rinsing ③ | 30–35° C. | 20 sec. | 350 ml | 10 l |
| Drying | 70–80° C. | 60 sec. | | |

Note: *Replenisher amount: ml per $m^2$ of photographic material
Rinsing steps were carried out in three tanks counter-current flow system from tank of rinsing ③ toward tank of rinsing ①.

The compositions of each processing solution were as follows:

| Color developer | Tank Solution | Replenisher |
|---|---|---|
| Water | 800 ml | 800 ml |
| Ethylenediamine-N,N,N,N-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfonate | 5.0 g | 7.0 g |
| N,N-Bis(carboxymethyl)hydrazine | 5.5 g | 7.0 g |
| Fluorescent brightening agent (WHITEX-4, | 1.0 g | 2.0 g |

-continued

| | | |
|---|---|---|
| made by Sumitomo Chemical Ind. Co.) | | |
| Water to make | 1000 ml | 1000 ml |
| pH (25° C.) | 10.05 | 10.45 |

| Bleach-fixing solution (Both tank solution and replenisher) | |
|---|---|
| Water | 400 ml |
| Ammonium thiosulfate (70%) | 100 ml |
| Sodium sulfite | 17 g |
| Iron (III) ammonium ethylenediamine-tetraacatate dihydrate | 55 g |
| Disodium ethylenediaminetetraacetate | 5 g |
| Ammonium bromide | 40 g |
| Water to make | 1000 ml |
| pH (25° C.) | 5.40 |

| Rinsing solution (Both tank solution and replenisher) |
|---|
| Ion-exchanged water (Calsium and magnesium each are contained in an amount of 3 ppm or below) |

TABLE 1

| | Red-sensitive Emulsion Layer | | Green-sensitive Emulsion Layer | | |
|---|---|---|---|---|---|
| Sample | BS(C)-BS(A) | Gamma Ratio (A/C) | BS(C)-BS(B) | Gamma Ratio (B/C) | Remarks |
| (101) | 1.6 | 1.00 | 2.2 | 0.85 | Comparative Example |
| (102) | 1.6 | 1.00 | 1.3 | 0.83 | " |
| (103) | 2.0 | 0.43 | 1.7 | 0.85 | " |
| (104) | 2.0 | 0.62 | 1.7 | 0.85 | This Invention |
| (105) | 2.0 | 0.80 | 1.7 | 0.85 | " |
| (106) | 2.0 | 1.01 | 1.7 | 0.85 | " |
| (107) | 2.0 | 1.28 | 1.7 | 0.85 | " |
| (108) | 2.0 | 1.40 | 1.7 | 0.85 | Comparative Example |
| (109) | 2.1 | 1.02 | 1.6 | 0.45 | " |
| (110) | 2.1 | 1.02 | 1.6 | 0.65 | This Invention |
| (111) | 2.1 | 1.02 | 1.6 | 0.85 | " |
| (112) | 2.1 | 1.02 | 1.6 | 1.05 | " |
| (113) | 2.1 | 1.02 | 1.6 | 1.23 | " |
| (114) | 2.1 | 1.02 | 1.6 | 1.50 | Comparative Example |
| (115) | 2.5 | 1.00 | 1.7 | 0.52 | " |
| (116) | 2.5 | 1.02 | 2.2 | 0.86 | " |
| (117) | 2.2 | 0.95 | 1.4 | 0.76 | This Invention |

TABLE 2

| Sample | Color Reproduction* | Detail Reproduction* | Remarks |
|---|---|---|---|
| (101) | 33 | 29 | Comparative Example |
| (102) | 20 | 30 | " |
| (103) | 34 | 24 | " |
| (104) | 38 | 40 | This Invention |
| (105) | 41 | 42 | " |
| (106) | 41 | 44 | " |
| (107) | 40 | 46 | " |
| (108) | 35 | 28 | Comparative Example |
| (109) | 31 | 23 | " |

TABLE 2-continued

| Sample | Color Reproduction* | Detail Reproduction* | Remarks |
|---|---|---|---|
| (110) | 44 | 40 | This Invention |
| (111) | 45 | 42 | " |
| (112) | 47 | 44 | " |
| (113) | 45 | 45 | " |
| (114) | 32 | 28 | Comparative Example |
| (115) | 30 | 18 | " |
| (116) | 34 | 20 | " |
| (117) | 44 | 46 | This Invention |

Note: Figures are shown as sum of 10 panellers's evaluation according to the following criteria of evaluation: 5: superior 4: good 3: normal 2: bad 1: very bad As is apparent from the results in Table 2, from Samples (104) to (107), (110) to (113), and (117) of the present invention prints excellent in color reproduction and detail reproduction of a color image having shades were obtained compared with comparative examples.

EXAMPLE 2

Samples 201 to 216 were prepared by the same procedure as Sample 117in Example 1, except that red-sensitive sensitizing dye and blue-sensitive sensitizing dye in the emulsion of red-sensitive emulsion layer were changed as shown in Table 3.

Color reproduction and detail reproduction of each sample printed practical negative film as same as in Example 1 were evaluated. Results are shown in Table 4.

TABLE 3

| | Sensitizing Dye For | | Red-sensitive Emulsion Layer | | |
|---|---|---|---|---|---|
| Sample | Red-sensitive | Blue-sensitive | BS(C)-BS(A) | Gamma Ratio (A/C) | Remarks |
| 201 | S-34 | — | 2.7 | 0.48 | Comparative Example |
| 202 | S-34 | S-4 | 2.0 | 0.46 | " |
| 203 | S-34 | S-4 | 2.0 | 1.01 | This Invention |
| 204 | S-34 | S-4 | 2.0 | 1.44 | Comparative Example |
| 205 | S-34 | S-7 | 1.9 | 0.96 | This Invention |
| 206 | S-34 | S-8 | 2.0 | 1.02 | " |
| 207 | S-38 | — | 2.7 | 0.50 | Comparative Example |
| 208 | S-38 | S-4 | 2.1 | 1.05 | This Invention |
| 209 | S-38 | S-6 | 2.1 | 0.97 | " |
| 210 | S-38 | S-7 | 2.1 | 0.99 | " |
| 211 | S-38 | S-8 | 2.1 | 1.02 | " |
| 212 | S-36 | — | 2.7 | 0.50 | Comparative Example |
| 213 | S-36 | S-4 | 2.0 | 1.10 | This Invention |
| 214 | S-36 | S-6 | 2.0 | 1.03 | " |
| 215 | S-36 | S-8 | 2.0 | 0.90 | " |
| 216 | S-45 | S-6 | 1.8 | 0.80 | " |

TABLE 4

| Sample | Color Reproduction* | Detail Reproduction* | Remarks |
|---|---|---|---|
| (201) | 39 | 25 | Comparative Example |
| (202) | 36 | 28 | " |
| (203) | 46 | 43 | This Invention |
| (204) | 39 | 30 | Comparative Example |
| (205) | 44 | 44 | This Invention |
| (206) | 45 | 43 | " |
| (207) | 37 | 26 | Comparative Example |
| (208) | 42 | 43 | This Invention |
| (209) | 45 | 43 | " |
| (210) | 44 | 46 | " |
| (211) | 45 | 43 | " |
| (212) | 38 | 24 | Comparative Example |
| (213) | 46 | 43 | This Invention |
| (214) | 45 | 45 | " |
| (215) | 42 | 42 | " |
| (216) | 44 | 45 | " |

Note: Figures are shown results as the same evaluation as in Table 2.

As is apparent from the results in Table 4, from Samples (203), (205), (206), (208)to (211), and (213) to (216)of the present invention prints excellent in color reproduction and detail reproduction of a color image having shades were obtained compared with comparative examples.

EXAMPLE 3

Samples (301) to (304) were prepared by the same procedure as Samples (201) to (211), except that the sensitizing dye was added immediately before coating instead of at chemical-sensitizing step, and Samples (305) to (308) were prepared by the same procedure as Samples (201) to (211), except that the sensitizing dye was added at the grain-forming step instead of at chemical-sensitizing step.

Color reproduction and detail reproduction of each samples printed practical negative film as same as in Example 1 were evaluated. Results are shown in Table 5.

TABLE 5

| Sample | Blue-sensitive Sensitizing Dye | Red-sensitive Emulsion Layer BS(C)-BS(A) | Red-sensitive Emulsion Layer Gamma Ratio (A/C) | Color Reproduction* | Detail Reproduction* | Remarks |
|---|---|---|---|---|---|---|
| (301) | S-4 | 2.3 | 0.43 | 40 | 28 | Comparative Example |
| (302) | S-6 | 2.3 | 0.46 | 38 | 26 | Comparative Example |
| (303) | S-7 | 2.2 | 0.44 | 39 | 28 | Comparative Example |
| (304) | S-8 | 2.2 | 0.45 | 38 | 29 | Comparative Example |
| (305) | S-4 | 2.0 | 1.03 | 42 | 46 | This Invention |
| (306) | S-6 | 2.1 | 0.99 | 44 | 43 | This Invention |
| (307) | S-7 | 2.0 | 1.01 | 44 | 44 | This Invention |
| (308) | S-8 | 1.9 | 1.01 | 44 | 45 | This Invention |

Note: *The same evaluation as in Table 2

As is apparent from the results in Table 5, in the case of Samples (301) to (304) in which the sensitizing dye was added immediately before coating, the value of BS(C)−BS(A) and gamma ratio A/C did not fall in preferable range, and color reproduction and detail reproduction of image having shades were inferior. On the other hand, Samples (305) to (308) of the present invention of image having shades were inferior. On the other hand, Samples (305) to (308) of the present invention in which the sensitizing dye was added at the grain-forming step showed good results as same as Samples (208) to (211) in which the sensitizing dye was added at chemical-sensitizing step.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide color photographic material having a red-sensitive silver halide emulsion layer (A), a green-sensitive silver halide emulsion layer (B), and a blue-sensitive silver halide emulsion layer (C), which comprises in said layers (A), (B), and (C) silver chlorobromide emulsions having silver chloride contents of 95 mol % or over, the silver halide emulsions of the layers (A) and/or (B) being spectrally sensitized in the blue light region in the grain-forming step and/or the chemically sensitizing step, to meet the following relationships:

$$1.8 \leqq BS(C)-BS(A) \leqq 2.4 \text{ and}$$

$$1.4 \leqq BS(C)-BS(B) \leqq 2.0,$$

wherein BS(A), BS(B), and BS(C) represent the blue sensitivities of the layer (A), the layer (B), and the layer (C), respectively, in terms of log (1/exposure amount) at the time when the optical density of cyan, magenta, and yellow is 1.0, and two or more silver halide emulsions being mixed in each of the layers (A) and (B) so that the gammas of the layers (A) and (B) in the photosensitive region of the layer (C) may be 0.6 to 1.3 times that of the layer (C).

2. The silver halide color photographic material as claimed in claim 1, wherein said silver halide color photographic material comprises a pyrazoloazole coupler represented by the following formula (M-II): Formula (M-II)

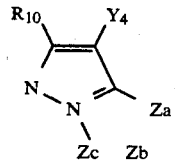

wherein $R_{10}$ represents a hydrogen atom or a substituent, $Y_4$ represents a hydrogen atom or a group capable of being released upon coupling reaction, Za, Zb, and Zc each represent methine, a substituted methine, =N—, or —NH—, and one of the Za—Zb bond and the Zb—Zc bond is a double bond, and the other is a single bond, and when Zb—Zc bond is a carbon-carbon double bond, the double bond may be part of the aromatic ring, a dimer or more higher polymer may be formed through $R_{10}$ or $Y_4$, and when Za, Zb, or Zc is a substituted methine, a dimer or more higher polymer may be formed through the substituted methine.

3. The silver halide color photographic material as claimed in claim 1, wherein the silver chloride content in the silver chlorobromide emulsions is 98 mol % or over.

4. The silver halide color photographic material as claimed in claim 1, wherein the silver iodide content in the silver chlorobromide emulsions is 1 mol % or less.

5. The silver halide color photographic material as claimed in claim 1, having a silver bromide localized layer in a layered form or non-layered form which is present in the silver halide grains of the silver halide emulsion and/or on the surface of the silver halide grains of the silver halide emulsions.

6. The silver halide color photographic material as claimed in claim 1, wherein the average grain size of the silver halide grains contained in the silver of halide emulsions is 0.1 to 2 $\mu$m.

7. The silver halide color photographic material as claimed in claim 1, wherein the grain size distribution of the silver halide grains contained in the silver halide emulsions has a deviation coefficient of 20% or less.

8. The silver halide color photographic material as claimed in claim 1, wherein the silver halide grains of the silver halide emulsions have an average aspect ratio of 5 or over.

9. The silver halide color photographic material as claimed in claim 1, wherein the amount of the spectrally sensitizing dye to be added is in the range of $1\times10^{-6}$ to $1\times10^{-3}$ mol per mol of silver halide.

10. The silver halide color -photographic material as claimed in claim 1, wherein gammas of the layers (A) and (B) in the photosensitive region of the layer (C) are 0.8 to 1.1 times that of the layer (C).

* * * * *